United States Patent [19]

Schaffernicht et al.

[11] 4,231,627

[45] Nov. 4, 1980

[54] ELECTRON BEAM TUBE

[75] Inventors: Klaus Schaffernicht, Blaustein; Rainer Kolbeck, Ulm, both of Fed. Rep. of Germany

[73] Assignee: Licentia Patent-Verwaltungs-GmbH, Frankfurt am Main, Fed. Rep. of Germany

[21] Appl. No.: 12,477

[22] Filed: Feb. 15, 1979

[51] Int. Cl.[3] ..... H01J 9/38

[52] U.S. Cl. ..... 316/25; 313/174; 313/180; 313/481

[58] Field of Search ..... 316/25; 313/174, 180, 313/481

[56] References Cited

U.S. PATENT DOCUMENTS

| | | | |
|---|---|---|---|
| 3,149,716 | 9/1964 | Papacosta et al. | 313/481 X |
| 3,796,917 | 3/1974 | Hiller | 313/180 X |
| 3,952,226 | 4/1976 | Turnbull | 313/174 X |
| 4,018,489 | 4/1977 | Miller et al. | 316/25 X |

*Primary Examiner*—Richard B. Lazarus

*Attorney, Agent, or Firm*—Spencer & Kaye

[57] ABSTRACT

An electron beam tube having a getter surface and an electrically heatable cathode whose heating power is less than 250 mW, is provided with a metal member and that member is supplied with heating power of 500 mW to 10 Watt to be heated temporarily to above temperature 800° C., upon completion of evacuation of the tube and after production of the getter surface, to eliminate residual gas.

4 Claims, 1 Drawing Figure

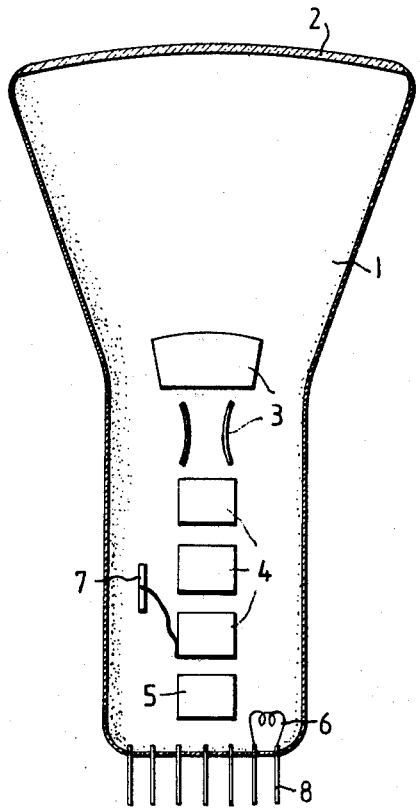
2
1
3
4
7
5
6
8

ELECTRON BEAM TUBE

BACKGROUND OF THE INVENTION

The present invention relates to an electron beam tube of the type having a gettering surface and an electrically heatable cathode whose heating power is less than 250 mW, and in particular less than 100 mW.

Electron beam tubes of this type are known in the art. It is also known to improve the vacuum in such a tube by vaporizing a getter, preferably of barium, so that a thin getter film is produced on the interior surfaces of the tube. These getter surfaces are able to bind residual gases in the tube.

It has now been found that, particularly in tubes having an extremely low cathode heating power, the danger of the cathode being poisoned by residual gases is particularly high. These residual gases generally contain hydrocarbons, such as, for example $CH_4$ or $C_2H_6$, which are absorbed only insufficiently or not at all by the getter materials, particularly by barium.

SUMMARY OF THE INVENTION

It is an object of the present invention to increase the cathode service life of such a tube. This and other objects are achieved according to the present invention by providing, inside such a tube, an additional metal member which can be heated to more than 800° C. and requires a heating power of 500 mW to 10 Watt to reach this temperature and by temporarily heating that member upon completion of the evacuation and after establishment of the gettering surface.

It is already known to additionally heat a cathode heater during so-called forming of the cathode, in order to obtain improved heating results. This, however, does not produce the desired results in the case of cathodes having a low heating power. Obviously, cathodes having a very low heating power have too few metal surfaces that are heated to a sufficiently high temperature. It seems to be for this reason that hydrocarbons are not decomposed sufficiently and remain in the tube. The additional metal member according to the invention provides a larger, very hot surface which has been found to be sufficient to dissociate, or crack, the hydrocarbons so that the dissociation components can be absorbed by the getter surfaces.

BRIEF DESCRIPTION OF THE DRAWING

The FIGURE is a schematic, cross-sectional view illustrating one preferred embodiment of the invention.

DESCRIPTION OF THE PREFERRED EMBODIMENTS

The FIGURE shows a small cathode ray tube 1 having a fluorescent screen 2 and a plurality of electrode passages 8. Inside the tube there is a beam generating system, of which electrodes 4 and 5 are shown schematically, as well as pairs of deflection plates 3. A gettering device 7 is further provided in the electron beam system, the device including, for example, a crucible containing preferably a barium compound which produces free barium at temperatures below 700° C. to be deposited in the form of a thin reflective barium film on surfaces inside the tube. Inside the electrode 5, which is, for example, a Wehnelt electrode, there is disposed, in a known manner, a cathode which preferably is of the directly heated type so that the tube can be operated with extremely low heating power. Preferably, the tube requires a heating power of less than 100 mW, and in particular about 35 mW.

According to the invention, the tube is provided with an additional metal member which is heatable to temperatures above 800° C. and requires a heating power of at least 500 mW to reach this temperature. Preferably, this metal member is made of tungsten, although molybdenum can also be used.

In a preferred embodiment of the invention, the member is a tungsten heating coil 6. Preferably, the metal member is heated to a temperature of at least 1000° C. This heating is effected at a time after the getter 7 has already vaporized and the tube has been evacuated and disconnected from the evacuation pump. Heating the additional metal member to such a high temperature dissociates or decomposes the hydrocarbons remaining in the tube so that the components thus formed can be absorbed by the getter film which has been deposited on the interior surfaces of the tube.

The metal member 6 should have as large a surface area as possible and sould require an electrical heating power of at least 500 mW to reach the desired temperature. A configuration of coil 6 where about 2 W are required for heating has been found to be particularly satisfactory. In a preferred embodiment of the invention the metal member 6 is a tungsten heating coil wound out of a tungsten wire of 100 mm length and a diameter of 50 microns. The total length of the coil is approximately 18 mm. It is wound with a pitch of about 0,0987 turns per millimeter length. When heated the resistance of the tungsten coil is about 26 ohms. The surface of the heating coil is approximately 16 $mm^2$.

In another preferred embodiment of the invention the heating coil is made of tungsten with an addition of 3% per weight rhenium. The dimensions of the coil are the same as in the afore mentioned embodiment of the invention.

In still another embodiment of the invention the heating coil is made of molybdenum with the same length, diameter, surface, and resistance as mentioned before. The additional metal member is maintained at the required temperature for at least one hour. By raising the temperature above 1000° C. this time can be slightly reduced.

It will be understood that the above description of the present invention is susceptible to various modifications, changes and adaptations, and the same are intended to be comprehended within the meaning and range of equivalents of the appended claims.

I claim:

1. In a method for evacuating an electron beam tube having an electrically heatable cathode whose heating power is less than 250 mW, which method includes producing a getter surface on interior walls of the tube, the improvement comprising and providing within the tube a metal member separate from the cathode and capable of being heated to above 800° C.; and supplying heating power to said member sufficient to heat it to above 800° C. after formation of the getter surface.

2. A method as defined in claim 1 wherein said step of supplying heating power is carried out to heat said member to above 950° C.

3. A method as defined in claim 1 wherein said step of supplying heating power is carried out to heat said member to above 1000° C.

4. A method as defined in claim 1, 2 or 3 wherein said step of supplying heating power is carried out by supplying power of 500 mW to 10 W.

* * * * *

UNITED STATES PATENT AND TRADEMARK OFFICE

CERTIFICATE OF CORRECTION

PATENT NO. : 4,231,627

DATED : November 4, 1980

INVENTOR(S) : Klaus Schaffernicht et al

It is certified that error appears in the above—identified patent and that said Letters Patent is hereby corrected as shown below:

In the heading of the patent, insert --Foreign Application Priority Data, Feb. 16, 1978 Fed. Rep. of Germany 2806534--

Column 2, line 21, change "sould" to --should--.

Signed and Sealed this

*Thirtieth* Day of *June 1981*

[SEAL]

*Attest:*

RENE D. TEGTMEYER

*Attesting Officer* *Acting Commissioner of Patents and Trademarks*